United States Patent [19]

Evans

[11] Patent Number: 4,896,984

[45] Date of Patent: Jan. 30, 1990

[54] LOTION APPLICATOR

[76] Inventor: Laurie A. Evans, P.O. Box 372, Lawton, Mich. 49065

[21] Appl. No.: 320,517

[22] Filed: Mar. 8, 1989

[51] Int. Cl.[4] ..... A45D 34/00

[52] U.S. Cl. ..... 401/140; 401/6; 401/203; 401/207

[58] Field of Search ..... 401/6, 207, 203, 204, 401/140

[56] References Cited

U.S. PATENT DOCUMENTS

| | | | |
|---|---|---|---|
| 2,061,219 | 11/1936 | Wright | 401/7 |
| 2,405,154 | 8/1946 | Logan | 401/7 |
| 3,701,604 | 10/1972 | Holroyd | 401/204 X |
| 4,078,865 | 3/1978 | Moser | 401/140 X |

FOREIGN PATENT DOCUMENTS

| | | | |
|---|---|---|---|
| 550505 | 12/1957 | Canada | 401/207 |
| 2203968 | 8/1973 | Fed. Rep. of Germany | 401/207 |

*Primary Examiner*—Steven A. Bratlie
*Attorney, Agent, or Firm*—Jerry T. Kearns

[57] ABSTRACT

A lotion applicator particularly designed for use in applying body lotions and suntan lotions includes an elongated body formed from a resilient material and configured to simulate a human hand and forearm. An internal passage extends through the foreman portion of the body and terminates in a lateral opening in the central palm area of the hand portion of the body. A sponge applicator includes a perforated mounting plate having a peripheral edge portion and removably received in an undercut groove formed adjacent the lateral opening. A threaded coupling is provided in the internal passage for connection of the threaded neck of a conventional lotion bottle. The device serves as a massage and lotion applicator and also as a novelty item.

1 Claim, 3 Drawing Sheets

LOTION APPLICATOR

BACKGROUND OF THE INVENTION

1. Field of the Invention

The present invention relates to lotion applicators, and more particularly pertains to a new and improved lotion applicator for use in applying body and suntan lotions which is configured to simulate a human hand to provide a massaging effect and to serve as an interesting novelty item.

2. Description of the Prior Art

Various types of lotion applicators are known in the prior art. A typical example of such a lotion applicator is to be found in U.S. Pat. No. 2,829,393, which issued to D. Turcotte on Apr. 8, 1958. This patent discloses a cosmetic and lotion applicator which includes an elongated stem having a ninety degree offset end portion having an attachment head for removably securing an applicator sponge. U.S. Pat. No. 3,124,828, which issued to A. Barber et al on Mar. 17, 1964, discloses a liquid applicator which includes an integral fluid reservoir. U.S. Pat. No. 4,078,865, which issued to R. Moser on Mar. 14, 1978, discloses a liquid applicator including an elongated body having a threaded coupling for engagement to a threaded neck of a liquid container and an opposite end provided with a scraper and a fluid applicator. The device is designed to apply liquids to the human body. U.S. Pat. No. 4,299,005, which issued to H. Brown on Nov. 10, 1981, discloses a lotion applicator which includes an elongated stem with a pivotal head which mounts an absorbent pad for applying lotions to the back of the human body. U.S. Pat. No. 4,483,636, which issued to T. Meyer on Nov. 20, 1984, discloses a suntan oil applicator which includes an elongated tubular member terminating in a perforated applicator disc and having an opposite end forming a hand grip and having a removable end cap.

While the above mentioned devices are directed to lotion applicators, none of these devices disclose a lotion applicator formed from a resilient material and configured to simulate a human hand and forearm to provide a realistic massaging effect and including a detachable sponge applicator for applying body and suntan lotions. Inasmuch as the art is relatively crowded with respect to these various types of lotion applicators, it can be appreciated that there is a continuing need for and interest in improvements to such lotion applicators, and in this respect, the present invention addresses this need and interest.

SUMMARY OF THE INVENTION

In view of the foregoing disadvantages inherent in the known types of lotion applicators now present in the prior art, the present invention provides an improved lotion applicator. As such, the general purpose of the present invention, which will be described subsequently in greater detail, is to provide a new and improved lotion applicator which has all the advantages of the prior art lotion applicators and none of the disadvantages.

To attain this, a representative embodiment of the concepts of the present invention is illustrated in the drawings and makes use of a lotion applicator particularly designed for use in applying body lotions and suntan lotions which includes an elongated body formed from a resilient material and configured to simulate a human hand and forearm. An internal passage extends through the forearm portion of the body and terminates in a lateral opening in the central palm area of the hand portion of the body. A sponge applicator includes a perforated mounting plate having a peripheral edge portion and removably received in an undercut groove formed adjacent the lateral opening. A threaded coupling is provided in the internal passage for connection of the threaded neck of a conventional lotion bottle. The device serves as a massage and lotion applicator and also as a novelty item.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended thereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lotion applicator which has all the advantages of the prior art lotion applicators and none of the disadvantages.

It is another object of the present invention to provide a new and improved lotion applicator which may be easily and efficiently manufactured and marketed.

It is a further object of the present invention to provide a new and improved lotion applicator which is of a durable and reliable construction.

An even further object of the present invention is to provide a new and improved lotion applicator which is susceptible of a low cost of manufacture with regard to both materials and labor, and which accordingly is then susceptible of low prices of sale to the consuming public, thereby making such lotion applicators economically available to the buying public.

Still yet another object of the present invention is to provide a new and improved lotion applicator which provides in the apparatuses and methods of the prior art some of the advantages thereof, while simultaneously overcoming some of the disadvantages normally associated therewith.

Still another object of the present invention is to provide a new and improved lotion applicator configured to simulate a human hand and forearm to provide a realistic massage effect and including a sponge applicator for applying body and suntan lotions.

Yet another object of the present invention is to provide a new and improved lotion applicator configured to simulate a human hand and forearm and having an internal passage terminating at a first end in a threaded coupling for engagement with a threaded neck of a lotion bottle and a second end terminating in a sponge applicator.

Even still another object of the present invention is to provide a new and improved lotion applicator configured to simulate a human hand and forearm which also provides an interesting novelty item.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
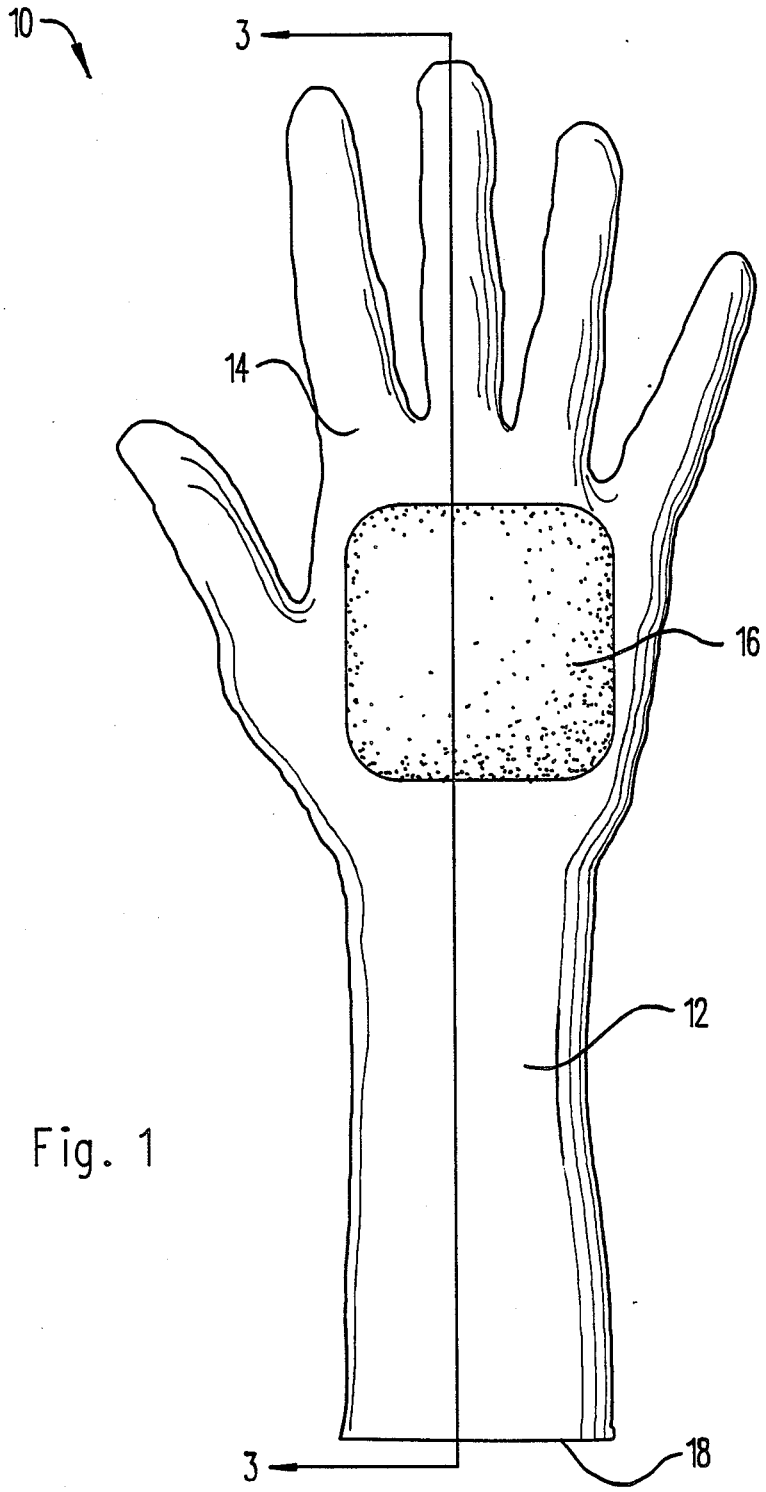
FIG. 1 is a plan view illustrating the palm side of the lotion applicator of the present invention.

With reference now to the drawings, and in particular to FIG. 1 thereof, a new and improved lotion applicator embodying the principles and concepts of the present invention and generally designated by the reference numeral 10 will be described.

More specifically, it will be noted that the first embodiment 10 of the invention includes an elongated body preferably formed from a resilient material such as a relatively hard rubber or slightly flexible plastic. A first portion 12 of the body is configured to simulate a human form and is connected to a second portion 14 configured to simulate a human hand. A sponge applicator is secured in a central palm area on the hand portion 14. The forearm portion 12 terminates at an end 18 having a threaded coupling for engagement with the threaded neck of a conventional lotion bottle.

Figure 2:
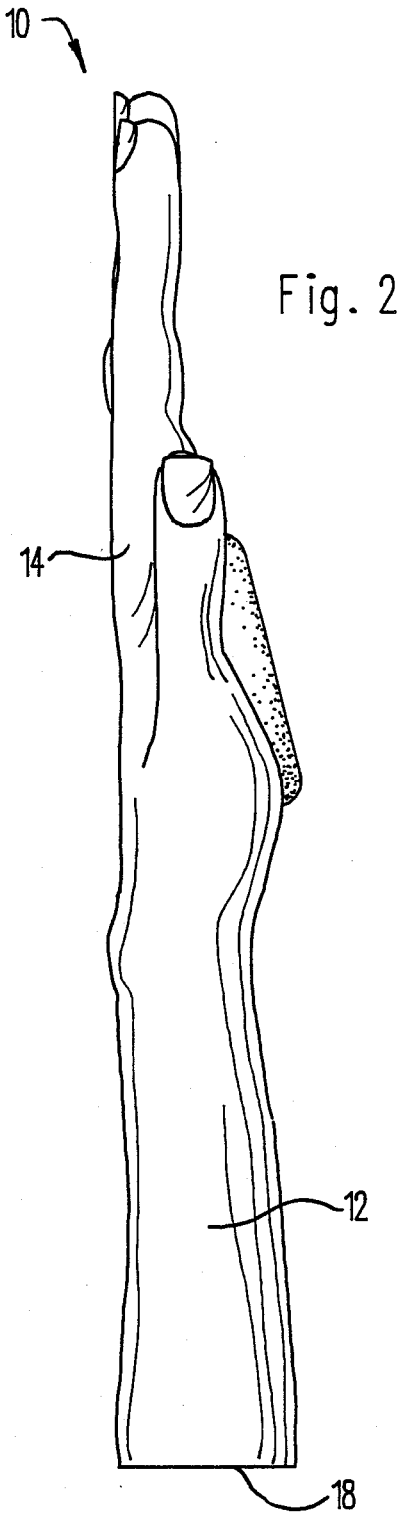
FIG. 2 is a side view of the lotion applicator of FIG. 1.

FIG. 2 is a side view of the lotion applicator 10 of FIG. 1.

Figure 3:
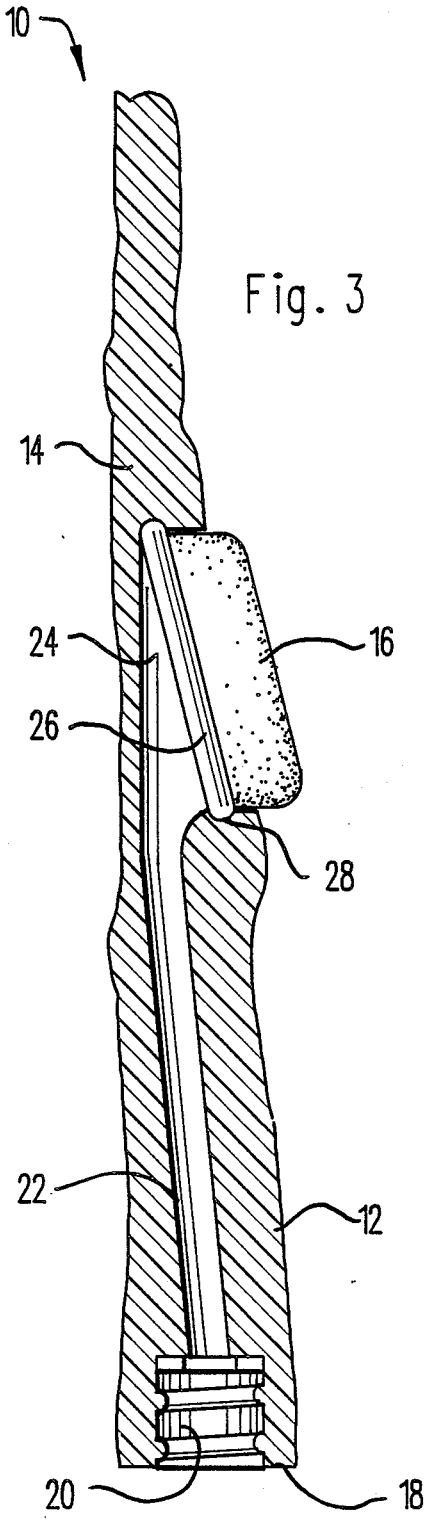
FIG. 3 is a longitudinal cross sectional view, taken along line 3—3 of FIG. 1.

As depicted in the cross sectional view of FIG. 3, an internal passage 22 extends through the forearm portion 12 and terminates at a first end in a threaded coupling 20 at the end portion 18 of the forearm portion 12. An opposite end of the internal passage 22 terminates in an enlarged lateral opening 24 which is disposed in the central palm area of the hand portion 14. A generally rectangular mounting plate 26 has a peripheral edge removably retained in an undercut groove 28 formed adjacent the lateral opening 24. Because of the slightly flexible nature of the material forming the forearm portion 12 and hand portion 14, the fingertip area of the hand 14 may be slightly flexed to enable removal of the mounting plate 26 from the undercut groove 28. The sponge 16 is secured on an outer surface of the mounting plate 26 which includes perforations to provide fluid communication between the internal passage 22 and the sponge 16. Thus, when the threaded neck of a conventional lotion bottle is engaged with the coupling 20, lotion may be supplied through the internal passage 22 out through the lateral opening 24, through the perforated mounting plate 26, and to the sponge applicator 16. By manipulating the forearm portion 12, an individual may apply body or suntan lotion and also receive a realistic massage effect. Additionally, the device serves as an interesting novelty item and as a conversation piece when used at public swimming areas and beaches.

Figure 4:
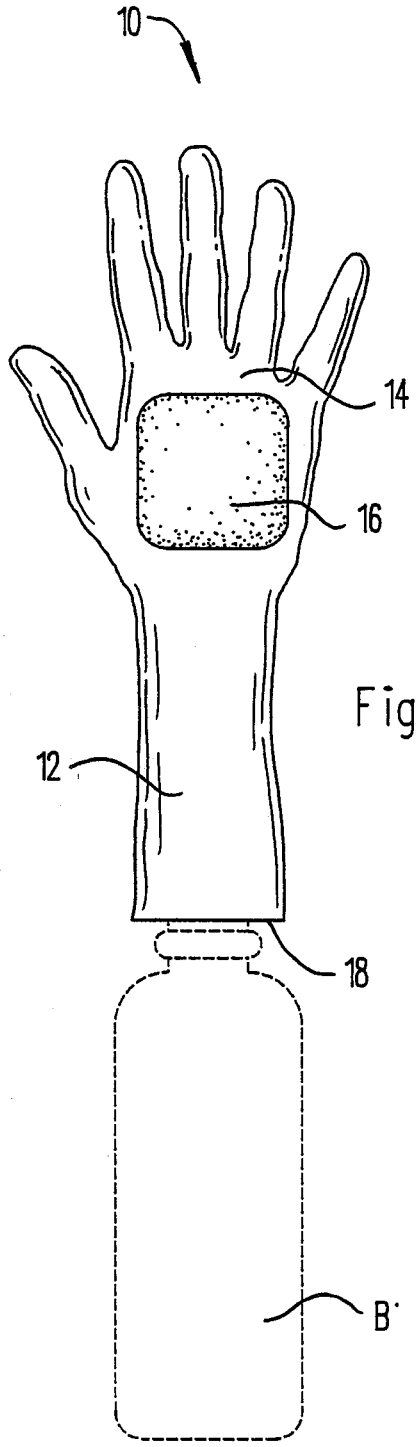
FIG. 4 is an illustration of the lotion applicator of the present invention attached to a conventional lotion bottle.

FIG. 4 illustrates the applicator 10 secured on the threaded neck portion of a conventional lotion bottle B. By squeezing the flexible conventional bottle B, lotion may be forced to the internal passage within the forearm portion 12 and applied via the sponge 16, as previously described.

Figure 5:
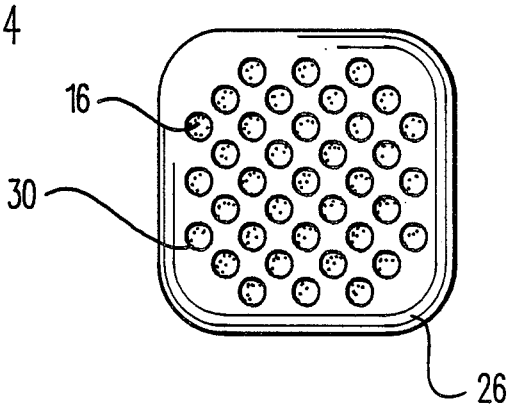
FIG. 5 is a back side view illustrating the perforated mounting plate of the sponge applicator.

FIG. 5 illustrates a back side view of the applicator mounting plate 26 which includes a plurality of perforations 30 which serve to conduct lotion to the sponge 16 secure on the front face of the mounting plate 26.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lotion applicator, comprising:

an elongated body formed from a resilient material;

a first portion of said body configured to simulate a human forearm;

a second portion of said body configured to simulate a human hand;

an internal passage extending through said first portion and terminating at a first end in an enlarged lateral opening in a central palm area of said second portion;

said internal passage terminating at a second end in a threaded coupling at an end of said first portion for engagement with a threaded neck of a lotion bottle;

a finger area disposed at an end of said elongated body opposite said threaded coupling;

an arcuate undercut groove formed within said palm area of said second portion, adjacent said lateral opening;

said undercut groove and said lateral opening forming a reduced thickness connection between said palm area and said finger area, said reduced thickness connection having a greater flexibility than remaining portions of said elongated body;

a perforated mounting plate having an arcuate peripheral edge portion removably received in said undercut groove; and a sponge applicator secured on an outer surface of said mounting plate and having an outer portion exposed through said lateral opening, whereby said sponge applicator may be removed by flexing said finger area to release said mounting plate from said undercut groove.

* * * * *